United States Patent [19]

Mestetsky

[11] Patent Number: 5,056,930

[45] Date of Patent: Oct. 15, 1991

[54] SELF-SEALING SPECIMEN POUCH ASSEMBLY

[75] Inventor: Thomas Mestetsky, St. Charles, Ill.

[73] Assignee: Hargro Lamcote, Inc., Chicago, Ill.

[21] Appl. No.: 664,816

[22] Filed: Mar. 5, 1991

[51] Int. Cl.[5] ..... B65D 33/20

[52] U.S. Cl. ..... 383/5; 383/40; 383/66; 383/88; 604/410

[58] Field of Search ..... 383/5, 38, 40, 66, 88; 206/66, 438; 604/262, 408, 409, 410

[56] References Cited

U.S. PATENT DOCUMENTS

| | | | |
|---|---|---|---|
| 2,344,369 | 3/1944 | Salfisberg | 383/38 |
| 3,762,628 | 10/1973 | Sargent | 383/40 |
| 3,905,477 | 9/1975 | Graham | 604/408 |
| 4,276,982 | 7/1982 | Sibrava et al. . | |
| 4,509,196 | 4/1985 | Sak et al. | 383/66 |
| 4,510,621 | 4/1985 | Sak et al. . | |
| 4,648,860 | 3/1987 | Cassey | 383/40 |
| 4,709,399 | 11/1987 | Sanders | 383/66 |
| 4,744,673 | 5/1988 | Nakamura | 383/39 |
| 4,927,405 | 5/1990 | Martin et al. | 383/38 |
| 5,509,196 | 4/1985 | Sak et al. . | |

FOREIGN PATENT DOCUMENTS

| | | | |
|---|---|---|---|
| 2066209 | 7/1981 | United Kingdom | 383/40 |
| 2081215 | 2/1982 | United Kingdom | 383/38 |

*Primary Examiner*—Stephen P. Garbe

*Attorney, Agent, or Firm*—Dressler, Goldsmith, Shore, Sutker & Milnamow, Ltd.

[57] ABSTRACT

A disposable, self-sealing pouch assembly defines a specimen-receiving enclosure and an associated pocket for receiving an identification card or the like. The assembly preferably includes first, second, and third rectangular piles of transparent plastic film. The first and second plies are joined at peripheral portions thereof to define a specimen-receiving enclosure with an access opening defined by the second ply providing access to the interior enclosure. The third ply is joined to the second ply and defines a card-receiving pocket therewith. Pressure-sensitive adhesive provided at the access opening effects self-sealing of the assembly, with the assembly configured to close the card-receiving pocket upon closing and sealing of the specimen-receiving enclosure.

10 Claims, 2 Drawing Sheets

10
12
14
16
18
20
22
23
24
26
28
30
32
L
C
5

SELF-SEALING SPECIMEN POUCH ASSEMBLY

TECHNICAL FIELD

The present invention relates generally to a self-sealing disposable pouch suited for receiving specimens such as for test analysis, and more particularly to a self-sealing pouch assembly including an integral pocket for receiving an associated identification card or the like, which pocket is automatically closed attendant to sealing of the pouch assembly.

BACKGROUND OF THE INVENTION

Self-sealing disposable pouch assemblies find widespread application for handling and storage of medical articles and instruments, and for disposal of waste materials. Moreover, such self-sealing pouch assemblies can readily be configured for use in handling and storage of specimens for test analysis, such as urinalysis. Pouch assemblies of this nature typically include a pair of substantially coextensive, rectangular plastic film plies or webs which are joined together, such as by heat-sealing, to define an interior enclosure. An access opening to the assembly is typically defined by one of the plies of material, with pressure-sensitive adhesive provided in the region of the access opening for effecting closing and sealing of the assembly after the desired specimen has been placed therein.

As will be appreciated, specimens which are to be subjected to analysis need to be provided with some form of identification, and to this end, some previous pouch assemblies have included an additional ply of material configured to define a pocket-like structure for receiving an identification card or the like. While such constructions facilitate specimen identification, and help to preclude possible confusion in the handling of a number of specimens, previous constructions have been undesirably complex, and therefore relatively expensive.

Specifically, one such previous construction includes a pair of first and second plies of material joined together to define a specimen-receiving enclosure. The first of the two plies defines an access opening, which is provided with an associated pressure-sensitive adhesive for effecting closing and sealing of the opening.

In this previous construction, a third ply of material is joined to the second of the two plies, and defines therewith a pocket for receiving an identification card or the like. However, by virtue of the arrangement of the main adhesive sealing construction at the first ply of material, a separate, second adhesive seal arrangement is necessary for use in connection with the card-receiving pocket to assure that the card remains in place in the pocket. Not only does this arrangement undesirably add to the expense of such an assembly, but further complicates the manner in which the assembly must be manipulated in order to place a specimen therein together with an associated identification means.

The present invention contemplates a disposable pouch assembly which is particularly configured to facilitate economical manufacture and convenient use.

SUMMARY OF THE INVENTION

A self-sealing disposable pouch assembly embodying the principles of the present invention comprises plural plies or webs of preferably transparent, plastic film material which are arranged so as to define a specimen-receiving enclosure, and an associated pocket for receiving an identification card or the like. Notably, the assembly is configured such that closing and sealing of the specimen-receiving enclosure automatically acts to close the associated pocket. Thus, both the specimen and any associated identification card of the like are conveniently positioned and retained within the pouch assembly.

In accordance with the illustrated embodiment, the present pouch assembly includes first, second, and third rectangular plies of material, preferably comprising transparent plastic film, with the plies being juxtaposed and at least partially coextensive with each other. The first and second plies are joined to each other at confronting peripheral portions thereof, preferably by heat-sealing, to together define a specimen-receiving enclosure therebetween.

In order to place the specimen within the enclosure, the second ply of material defines an access opening which communicates with the enclosure. In the preferred form, the first and second plies are coextensive with each other and joined to each other substantially throughout the length of the confronting peripheral portions thereof. Preferably, the access opening is transversely extending, and defined by the second web in spaced relationship from an associated end of the pouch assembly.

The third ply of material is joined to the second ply, to thereby define an identification-receiving pocket therebetween. The third ply has a length which is less than the second ply so that a free edge of the third ply defines, with the second ply, an opening into the pocket. The construction of the pouch is such that the access opening into the specimen-receiving enclosure, defined by the second ply, is positioned between the pocket opening and the associated end of the pouch assembly.

Closing and sealing of the pouch is effected by a self-sealing arrangement, preferably provided in the form of pressure-sensitive adhesive which is associated with the access opening defined by the pouch. The self-sealing arrangement is configured to effect closing of the access opening by folding and sealing an end portion of the pouch assembly, thus closing the access opening. Notably, the folded end portion of the pouch assembly extends to partially overlie the third ply and thereby close the opening into the pocket, thus retaining an associated identification card or the like positioned therein.

In the preferred embodiment, the pressure-sensitive adhesive of the self-sealing arrangement is disposed on respective opposite sides of the access opening, and most preferably substantially surrounds the access opening. In this manner, an adhesive-to-adhesive seal is formed upon closing of the access opening, which desirably provides a tamper-evident seal for the contents of the specimen-receiving enclosure.

To facilitate convenient use of the pouch assembly, the assembly preferably includes an adhesive release strip removably secured to the pressure-sensitive adhesive to maintain the adhesive in a fresh condition prior to use. In the preferred form, the release strip defines a slit substantially coextensive with the access opening, thereby facilitating insertion of a specimen into the pouch assembly prior to removal of the release strip.

Other features and advantages of the present invention will become readily apparent from the following detailed description, the accompanying drawings, and the appended claims.

DETAILED DESCRIPTION

Figure 2:
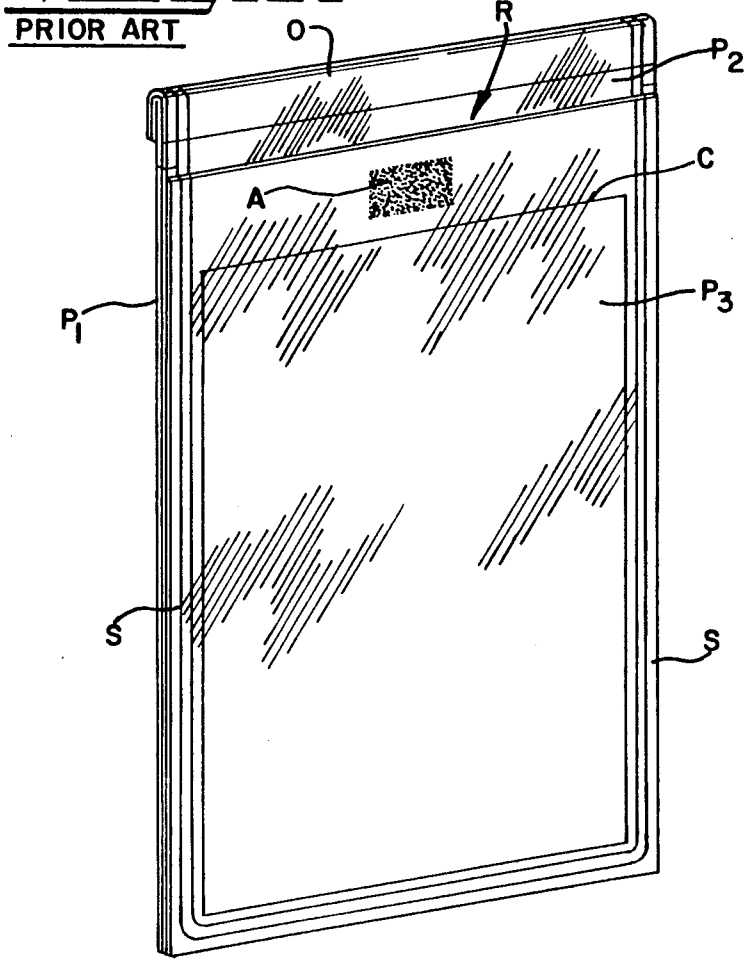
FIG. 2 PRIOR ART
FIG. 2 is a further perspective view of the prior art pouch assembly shown in FIG. 1.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Figure 1:
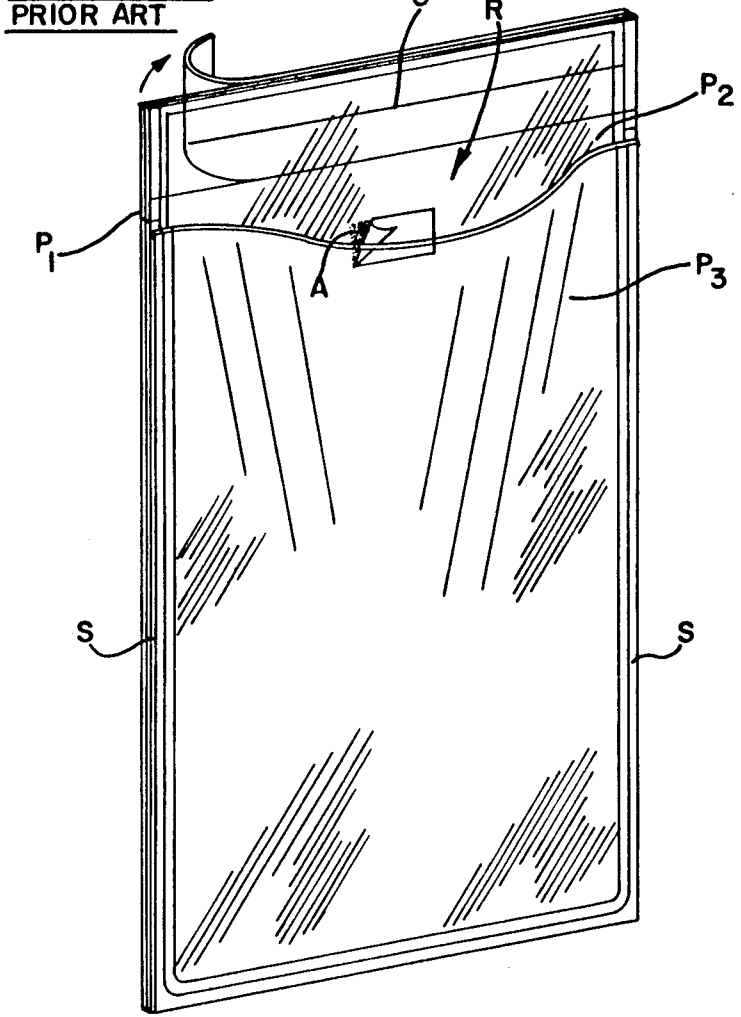
FIG. 1 PRIOR ART
FIG. 1 is a perspective view of a prior art self-sealing pouch assembly.

With reference first to FIGS. 1 and 2, therein is illustrated a prior art self-sealing pouch assembly. This pouch assembly comprises first, second, and third plies of material, respectively, $P_1$, $P_2$, and $P_3$. As illustrated, the first and second plies $P_1$ and $P_2$ are joined to each other at peripheral portions thereof, generally along a heat-seal designated S, with the first and second plies thereby defining an enclosure therebetween such as for receiving a specimen for testing or the like. In distinction, the third ply $P_3$ is joined to the second ply $P_2$, but is shorter than the second ply. The third ply $P_3$ is joined to the second ply $P_2$ along three edges of the third ply, with a fourth edge of the third ply unsecured to thereby define with the second ply a card-receiving pocket R.

Access to the specimen-receiving enclosure of the pouch, between the first and second plies $P_1$ and $P_2$, is provided by means of an access opening 0 defined by the first ply generally at the side of the pouch opposite that side at which pocket R is provided. The access opening 0 is substantially surrounded by pressure-sensitive adhesive provided on the first ply $P_1$, with the adhesive maintained in a fresh condition by a release strip, which may be provided with a slit coextensive with the access opening 0. After a specimen has been placed in the pouch, the release strip can be removed, and the end portion of the pouch, including the first and second plies, folded generally along a line defined by the access opening. The specimen-receiving enclosure of the pouch is thus sealed, as illustrated in FIG. 2, by an adhesive-to-adhesive seal formed by the pressure sensitive adhesive provided at the access opening.

Access to the contents of the pouch, after sealing, is facilitated by the provision of a pair of slits T. The slits T extend partially into the peripheral seal S, and permit the pouch assembly to be opened by tearing across the width of the assembly.

The pocket R is intended to receive an associated identification card C or the like. However, because of the importance of maintaining the correct identification card with the correct specimen, this prior art construction has included a pressure-sensitive adhesive A, having its own release strip as shown in FIG. 1, at the surface of the second ply $P_2$ which faces, and is generally overlapped by, the free edge portion the third ply $P_3$. In essence, the adhesive A and its release strip are positioned within the pocket R. After the release strip is removed from the pressure-sensitive adhesive A, an identification card C positioned in the pocket R can be retained in position therein by adhering the free edge portion of the third ply $P_3$ to the adhesive A on the confronting surface of second ply $P_2$.

As will be appreciated, this prior art construction requires not only that the desired specimen be placed in the assembly and sealed therein, but further requires manipulation of the release strip on the adhesive A, and subsequent securement of the adhesive in order to assure that the identification card C remains in position in the pocket R. Naturally, this complicates use of the pouch assembly. Moreover, this assembly requires that the pressure-sensitive adhesive A, and its associated release strip, be placed in position on the second ply $P_2$ prior to joining of the third ply $P_3$ to the second ply $P_2$. As will be appreciated, this complicates manufacture of the pouch assembly, thus adding to its expense.

Figures 3, 4, 5:
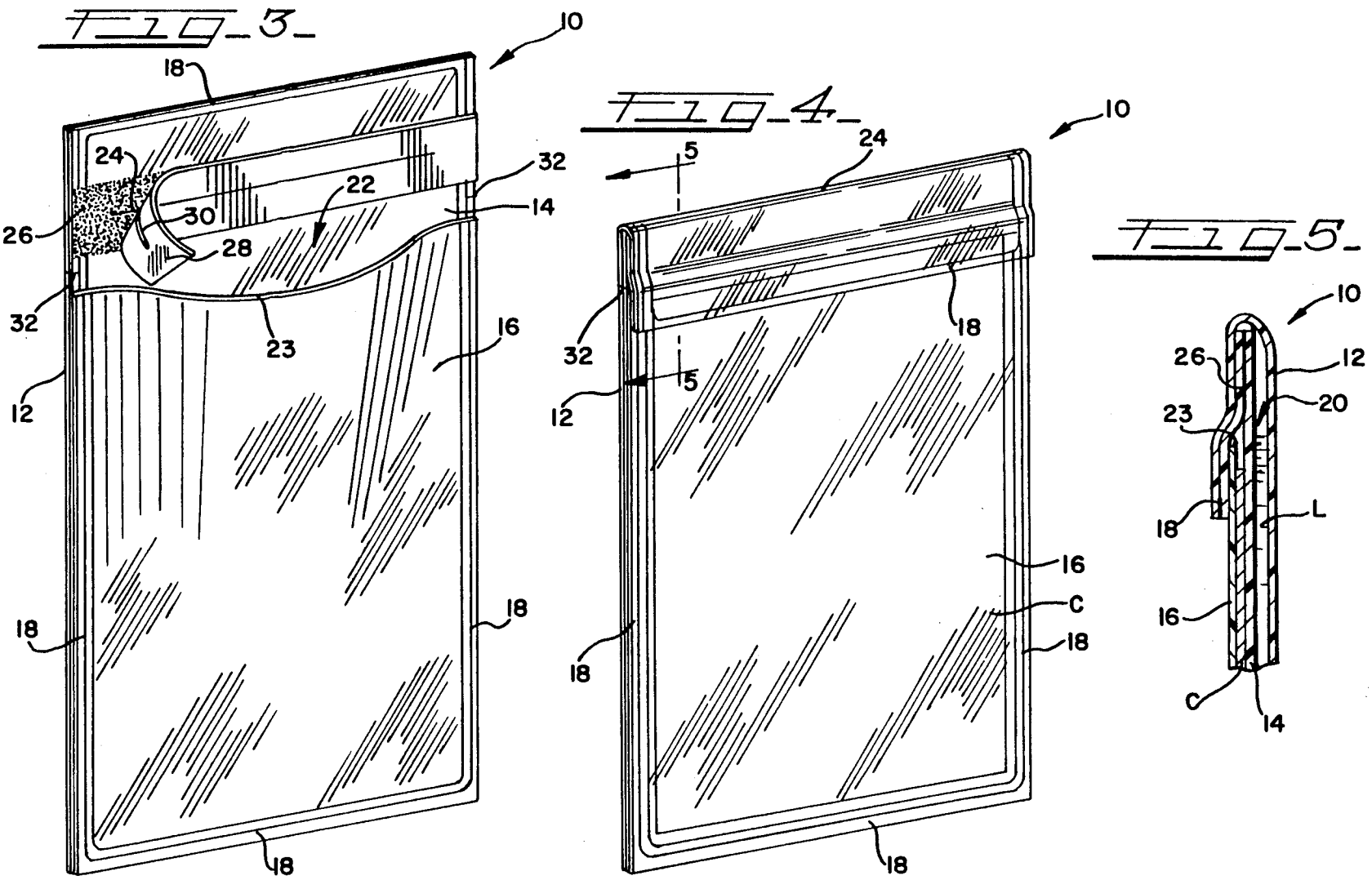
FIG. 3 is a perspective view of a self-sealing pouch assembly embodying the principles of the present invention.
FIG. 4 is a further perspective view of the self-sealing pouch illustrated in FIG. 3 showing the pouch in a closed condition.
FIG. 5 is a partial cross-sectional view taken along lines 5—5 of FIG. 4.

With reference now to FIGS. 3–5, therein is illustrated an improved, disposable self-sealing pouch assembly 10 embodying the principals of the present invention. As will be further described, pouch 10 is particularly configured to facilitate convenient use and economical manufacture, in that the arrangement which effects self-sealing of the pouch assembly automatically acts to close an identification-card receiving pocket of the construction.

The pouch assembly 10 includes first, second, and third rectangular plies of material, respectively designated 12, 14, and 16. The web-like plies of material preferably comprise transparent plastic film, such as polyethylene, which can be joined, such as by heat-sealing, in an economical and cost-effective manner.

The configuration of pouch assembly 10 is such that the plies of material define a specimen-receiving enclosure and an adjacent card-receiving pocket. Specifically, the first and second plies 12 and 14 are joined to each other at confronting peripheral portions thereof, designated at seal 18, with the first and second plies thus defining therebetween a specimen-receiving enclosure 20 (see FIG. 5). The first and second plies 12 and 14 are preferably coextensive throughout their length, with the preferably rectangular plies joined together along all four sides thereof, substantially throughout the length of their confronting peripheral portions at the seal 18.

In contrast, the preferably rectangular third ply 16 is joined to the second ply along three sides thereof at the seal 18, to thereby define an identification-receiving pocket 22 between the second and third plies. The third ply has a length which is less than that of the second ply so that a free edge 23 of the third ply defines, with the second ply, an opening into the pocket 22.

In order to place a specimen into the pouch assembly 10, the second ply 14 defines a preferably transversely extending, access opening 24, preferably in the form of an access slit, which is positioned between the opening to the pocket 22 (at free edge 23), and an associated end of the pouch assembly. Self-sealing of the pouch assembly is effected by the preferred provision of pressure-sensitive adhesive 26 provided in operative association with the access opening 24. In the preferred form, the pressure-sensitive adhesive 26 is disposed on the second ply 14 on respective opposite sides of the transverse access opening 24, and most preferably, substantially surrounds the access opening to facilitate formation of a tamper-evident seal upon closing.

In order to maintain the pressure-sensitive adhesive in a fresh condition prior to use, the pouch assembly 10 preferably includes a release strip 28 which is removably secured to the adhesive. In the preferred form, the release strip defines a slit 30 which is substantially coextensive with the access opening 24 to thereby facilitate insertion of a specimen into the pouch assembly prior to removal of the release strip from the pressure-sensitive adhesive.

The present pouch assembly facilitates convenient closing and sealing, with the arrangement configured to automatically effect closing of the pocket 22 for retaining an identification card C or other identification means in the pocket. Specifically, a specimen is placed in the pouch assembly by manipulating the access opening 24, with the release strip 28 in place, so that the specimen can be passed through the release strip (through slit 30 therein) and through the access opening 24 into the enclosure 20 defined between the first and second plies 12 and 14 of the assembly. Prior or subsequent to placing the specimen in the assembly, an identification card C or the like can be placed in the pocket 22 by manipulating the free edge 23 of the third ply 16, and inserting the card between the second and third plies into the pocket 22.

Closing and sealing of the pouch assembly to the configuration illustrated in FIGS. 4 and 5, is readily effected by removal of the release strip 28, and folding of an end portion of the pouch, preferably generally along the extent of the transverse access opening 24 (i.e., the fold line is substantially aligned with the access opening), to thereby form an adhesive-to-adhesive tamper-evident seal. As will be appreciated, the folded over end portion, which comprises the juxtaposed portions of the first and second plies 12 and 14 which are positioned generally above the access opening 24 (referring to the orientation of the drawings) can be readily manipulated to provide the closing action.

Significantly, this folded end portion of the pouch assembly is dimensioned so that after folding, it overlaps free edge 23 and partially overlies the third ply 16 of the pouch assembly, thereby closing the opening into the pocket 22 to retain the associated identification card C therein. As will be appreciated, the preferred construction is such that the portion of the pouch between the access opening 24 and the upper free edge of the pouch assembly is larger than the distance between the access opening 24 and the free edge 23 of the third ply 16. Thus, after folding of the end portion of the pouch assembly along a line substantially coextensive with the access opening, the folded portion acts in a flap-like fashion to close, but not seal, the pocket 22. Since the pocket 22 is closed, but not sealed, the identification card C is retained therein, but can be conveniently removed, if desired, by manipulation of the folded-over portion, without breaking the seal of the interior enclosure of the pouch assembly in which the specimen, which may comprise a liquid specimen L (FIG. 5), is disposed.

Opening of the pouch assembly is conveniently effected by the preferred provision of one or more slits 3 (FIG. 3) which extend into the peripheral seal 18 between the first and second plies 12 and 14, preferably between the free edge 23 of the third ply 16 and the pressure-sensitive adhesive 26. By this arrangement of the slits 32, the folded over portion of the pouch assembly can be easily and conveniently torn away for access to the specimen therein by propagation of the slits transversely of the pouch assembly.

From the foregoing, it will be observed that numerous modifications and variations can be effected without departing from the true spirit and scope of the novel concept of the present invention. It is to be understood that no limitation with respect to the specific embodiment is intended or should be inferred. The disclosure is intended to cover by the appended claims all such modifications as fall within the scope of the claims.

What is claimed is:

1. A specimen pouch assembly, comprising:

first, second, and third plies of material, said plies being juxtaposed and at least partially coextensive, said first and second plies being joined to each other at confronting peripheral portions thereof to define a specimen-receiving enclosure therebetween, said second ply defining an access opening communicating with said enclosure for placing an associated specimen therein, said third ply being joined to said second ply to define an identification-receiving pocket therebetween, said third ply having a length less than said second ply so that a free edge of said third ply defines, with said second ply, an opening into said pocket, said access opening defined by said second ply being positioned between said pocket opening and an associated end of said pouch assembly, and self-sealing means for closing said access opening by folding and sealing an end portion of said pouch assembly to close said access opening, said folded end portion extending to overlap said free edge of said third ply and partially overlie said third ply and thereby close said opening into said pocket to retain associated identification means therein.

2. A specimen pouch assembly in accordance with claim 1, wherein said first and second plies of material are joined to each other substantially throughout the length of the confronting peripheral portions thereof, said access opening being provided by an access slit in said second ply spaced from the associated end of said pouch assembly.

3. A specimen pouch assembly in accordance with claim 1, wherein said self-sealing means comprises pressure-sensitive adhesive disposed on respective opposite sides of said access opening.

4. A specimen pouch assembly in accordance with claim 3, wherein said self-sealing means comprises pressure-sensitive adhesive substantially surrounding said access opening to provide a tamper-evident seal upon closing of said opening.

5. A specimen pouch assembly in accordance with claim 3, including release strip means removably secured to said pressure-sensitive adhesive to maintain said adhesive in a fresh condition prior to use, said release strip means defining a slit substantially coextensive with said access opening to facilitate insertion of a specimen into said pouch assembly prior to removal of said release strip means.

6. A specimen pouch assembly, comprising:

first, second, and third rectangular plies of material, said plies being juxtaposed and at least partially coextensive, said first and second plies being coextensive with each other and joined to each other substantially throughout the length of confronting peripheral portions thereof to define a specimen-receiving enclosure therebetween, said second ply defining a transversely extending access opening spaced from an associated end of said pouch assembly and communicating with said enclosure for placing an associated specimen therein, said third ply being joined to said second ply to define an identification-receiving pocket therebetween, said third ply having a length less than said second ply so that a free edge of said third ply defines, with said second ply, an opening into said pocket, said access opening defined by said second ply being positioned between said pocket opening and an associated end of said pouch assembly, and self-sealing means for closing said access opening by folding and sealing an end portion of said pouch assembly to close said access opening, said self-sealing means comprising pressure-sensitive adhesive disposed on said second ply on respective opposite sides of said access opening to form a tamper-evident seal, said folded end portion extending to overlap said free edge of said third ply and partially overlie said third ply and thereby close said opening into said pocket to retain associated identification means therein.

7. A specimen pouch assembly in accordance with claim 6, wherein said self-sealing means comprises pressure-sensitive adhesive on said second ply substantially surrounding said access opening so that said end portion can be folded generally along the extent of said transverse access opening to form a tamper-evidence seal.

8. A specimen pouch assembly in accordance with claim 6, including release strip means removably secured to said pressure-sensitive adhesive to maintain said adhesive in a fresh condition prior to use, said release strip means defining a slit substantially coextensive with said access opening to facilitate insertion of a specimen into said pouch assembly prior to removal of said release strip means.

9. A specimen pouch assembly in accordance with claim 6, wherein said first, second, and third plies comprise transparent plastic film material.

10. A specimen pouch assembly in accordance with claim 6, including means for opening said pouch assembly comprising at least one opening slit formed at the confronting peripheral portions of said first and second plies between said pressure sensitive adhesive and said free edge of said third ply.

* * * * *